US005787858A

United States Patent [19]

Meneely

[11] Patent Number: 5,787,858

[45] Date of Patent: Aug. 4, 1998

[54] ENGINE BRAKE WITH CONTROLLED VALVE CLOSING

[76] Inventor: Vincent Allan Meneely, 9837 McKinnon Crescent, R.R. No. 10, Langley, British Columbia, Canada, V3A 6Y5

[21] Appl. No.: 731,188

[22] Filed: Oct. 7, 1996

[51] Int. Cl.[6] ..... F02D 13/04

[52] U.S. Cl. ..... 123/321

[58] Field of Search ..... 123/320, 321, 123/322, 324

[56] References Cited

U.S. PATENT DOCUMENTS

| | | | |
|---|---|---|---|
| 1,573,417 | 2/1926 | Nolen . | |
| 1,624,574 | 4/1927 | Beach . | |
| 2,002,196 | 5/1935 | Ucko . | |
| 2,787,987 | 4/1957 | Portmann . | |
| 2,895,571 | 7/1959 | Hanebeck . | |
| 3,023,870 | 3/1962 | Udelman . | |
| 3,234,923 | 2/1966 | Fleck . | |
| 3,525,317 | 8/1970 | Muir | 123/97 |
| 4,111,166 | 9/1978 | Alstrin et al. | 123/97 B |
| 4,149,618 | 4/1979 | Horie | 188/273 |
| 4,285,311 | 8/1981 | Iio | 123/323 |
| 4,333,430 | 6/1982 | Rosquist | 123/321 |
| 4,556,027 | 12/1985 | Harris | 123/323 |
| 4,557,233 | 12/1985 | Joppig et al. | 123/323 |
| 4,707,987 | 11/1987 | Atkin | 60/324 |
| 4,751,899 | 6/1988 | Ohki et al. | 123/65 PE |
| 4,829,945 | 5/1989 | Yamamoto et al. | 123/65 PE |
| 4,848,289 | 7/1989 | Meneely | 123/182 |
| 4,893,698 | 1/1990 | Suzuki | 188/273 |
| 4,911,115 | 3/1990 | Boyesen | 123/65 PE |
| 4,936,273 | 6/1990 | Myers | 123/321 |
| 4,944,255 | 7/1990 | Duret | 123/65 EM |
| 4,981,119 | 1/1991 | Neitz et al. | 123/321 |
| 5,012,778 | 5/1991 | Pitzi | 123/321 |
| 5,036,810 | 8/1991 | Meneely | 123/321 |
| 5,086,738 | 2/1992 | Kubis et al. | 123/322 |
| 5,088,460 | 2/1992 | Echeverria | 123/322 |
| 5,146,890 | 9/1992 | Gobert et al. | 123/321 |
| 5,209,192 | 5/1993 | Ahmed et al. | 123/65 PE |
| 5,215,054 | 6/1993 | Meneely | 123/320 |
| 5,386,809 | 2/1995 | Reedy et al. | 123/320 |
| 5,572,971 | 11/1996 | Yokoyama | 123/323 |

*Primary Examiner*—Willis R. Wolfe
*Assistant Examiner*—Hieu T. Vo
*Attorney, Agent, or Firm*—Norman M. Cameron

[57] ABSTRACT

An engine retarding apparatus and method include an exhaust restrictor which raises exhaust pressure in the engine high enough to cause exhaust valves to float near the beginning of each compression stroke. There is an exhaust valve blocking device which blocks closing of each exhaust valve until at least near the end of each compression stroke. In one embodiment the exhaust restrictor is an engine brake and the exhaust valve blocking device includes an hydraulic actuator controlled by a solenoid valve. There is also provided an improved exhaust brake which provides a braking effect from compression strokes as well as exhaust strokes of the pistons.

28 Claims, 3 Drawing Sheets

ENGINE BRAKE WITH CONTROLLED VALVE CLOSING

BACKGROUND OF THE INVENTION

Various types of engine brakes have been devised to slow vehicles, particularly heavy diesel vehicles, without recourse to conventional wheel brakes. These devices can save wear and tear as well as overheating of the wheel brakes.

The most commonly known type of engine brake is a compression release brake. Most of these brakes utilize a mechanism, typically hydraulic actuators, to crack open each exhaust valve at the end of each compression stroke when the brake is in operation. This is to remove the rebound effect which would otherwise occur when the pressurized gases in the cylinders act upon the pistons. This rebound effect would cancel out the braking effect achieved during compression of gases in the cylinders.

Such compression release brakes however are disadvantageous in certain situations. They require accurate timing and hydraulic actuators capable of cracking open the exhaust valves precisely when required. Thus they may be relatively expensive and difficult or impossible to install on some engines.

A cheaper, though less effective alternative, is the so-called weeper brake. These brakes operate by cracking open the exhaust valves a small amount and keeping them open throughout operation of the brake. Some braking effect is achieved because the exhaust gases build up pressure and provide a braking effect as they are forced past the slightly cracked open valves. The rebound effect is however removed because the pressure in the cylinders does not build up sufficiently to cause an appreciable rebound effect.

However conventional brakes at this type have a wealness due to the fact that the valves are held open continuously. Thus air talken into the cylinders during the intake stroke is partially discharged through the cracked open exhaust valves, reducing the quantity of gases within the cylinders. This loss means that there is less gas in the cylinders to be compressed on the compression stroke, thus reducing the braking effect.

A third type of common engine brake is an exhaust brake. These brakes operate by selectively restricting exhaust flow from the engine, typically just past the exhaust manifold. These brakes are usually in the form of a butterfly valve in the exhaust conduit and are often operated by a fluid actuator. These brakes are simple and reliable as well as economical. However they do not produce a braking effect as great as a compression release brake. Also they conventionally provide the braking effect only on the exhaust stroke of each cylinder.

It is known to combine a compression release brake and an exhaust brake in the same engine. For example this is disclosed in my own earlier U.S. Pat. No. 4,848,289. This patent discloses the principle of increasing the pressure of exhaust gases, for example using an exhaust brake, sufficiently to crack open the exhaust valves on the intake stroke. The exhaust gases thus enter cylinders on the intake stroke, increasing the braking effect on the subsequent compression stroke. Thus the combination of the exhaust brake and a conventional engine brake has a synergistic effect. The braking effect achieved is greater than the total of the individual braking effects achieved by the exhaust brake and the compression release brake.

As mentioned above, conventional compression release brakes require actuators sufficiently strong to crack open exhaust valves at the end of each compression stroke. My earlier U.S. Pat. No. 5,215,054 addresses this problem by utilizing a mechanism for holding open the exhaust valves a small amount at the end of each exhaust stroke. This is done, for example, by a hydraulic actuator which moves into position against each exhaust valve during the exhaust stroke. The actuator is prevented from returning by a solenoid operated hydraulic valve. Each exhaust valve is held open until the end of the compression stroke when the hydraulic actuator is allowed to move away from each exhaust valve by opening a hydraulic valve associated therewith. The exhaust valve is held cracked open during the intake stroke which occurs between the exhaust stroke and the subsequent compression stroke. Accordingly this device does have some of the disadvantages of the common weeper brake discussed above.

It is an object of the invention to provide an improved engine brake which overcomes the disadvantages associated with the prior art.

It is also an object of the invention to provide an improved engine brake which is relatively inexpensive and simple compared to conventional compression release brakes.

It is a further object of the invention to provide an improved engine brake which is more effective than a conventional weeper brake or a conventional exhaust brake acting alone.

It is a still further object of the invention to provide an improved engine brake which is rugged and simple in construction, easy to install and reliable in operation.

SUMMARY OF THE INVENTION

There is provided according to one aspect of the invention, an engine retarding apparatus for an engine with cylinders and exhaust valves. The apparatus includes an exhaust restrictor capable of raising exhaust pressure high enough to cause each exhaust valve to float near the beginning of each compression stroke. There is an exhaust valve blocking device which blocks closing of said each exhaust valve until at least near the end of each compression stroke.

The blocking device may include a hydraulic actuator and a solenoid actuated hydraulic valve.

There is provided, according to another aspect of the invention, a method of retarding an engine having cylinders and exhaust valves. The method comprises the steps of restricting exhaust gas flow from the engine sufficiently to cause float of the exhaust valves prior to each compression stroke. Exhaust valves are held open during at least a portion of the compression stroke. Preferably each exhaust valve is released and allowed to close prior to each intake stroke. Each exhaust valve, for example, may be released near the end of the compression stroke.

There is provided, according to another aspect of the invention, an exhaust brake for an engine. An exhaust restrictor along the exhaust conduit is selectively operable to retard engine speed by restricting outflow of gases from the engine. There is means for selectively holding each exhaust valve open for a time beginning near bottom dead center of each compression stroke, thereby causing retarding of engine speed during the compression stroke.

The invention removes disadvantages associated with combinations of exhaust brakes and common weeper brakes. The exhaust valves are held in a cracked open position, but are released and allowed to close prior to each intake stroke. Accordingly the charge in each cylinder does not leak out partially through the cracked open exhaust valves during the intake stroke as with conventional weeper brakes.

The combination of the improved weeper brake and exhaust brake produces a synergistic effect giving a high percentage of the braking effect which would be achieved by a conventional compression release brake. However, the installation is considerable less complicated and generally more economical than installation of a conventional compression release brake. In addition, engine brakes according to the invention may be installed on many engines which are difficult or impossible to fit with conventional compression release brakes. Accordingly, the invention offers the advantages of engine brakes in applications where prior art engine brakes have been unavailable or provided a significantly inferior braking effect.

DETAILED DESCRIPTION OF THE PREFERRED EMBODIMENTS

Figure 1:
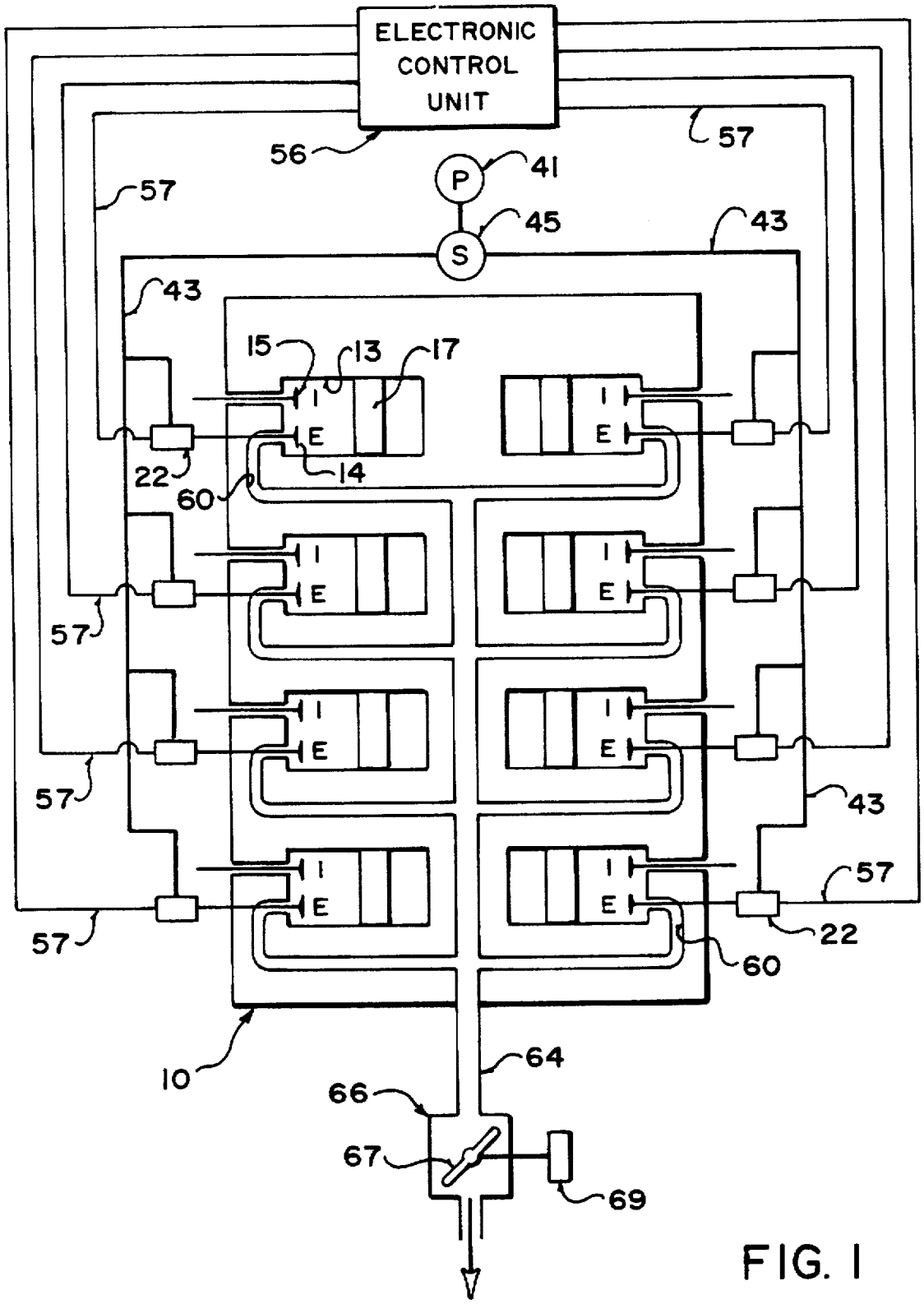
FIG. 1 is a schematic diagram of an engine brake according to an embodiment of the invention.

Referring first to FIG. 1, this shows, in diagrammatic form, an engine 10 equipped with a plurality of cylinders, such as cylinder 13. Each cylinder has a piston 17, an exhaust valve 14 and an intake valve 15. Each exhaust valve has an exhaust port such as port 60. The exhaust ports are connected to an exhaust conduit 64. An exhaust restrictor 66, in the form of an exhaust brake, is connected to conduit 64 and is provided with a butterfly 67 operated by a fluid actuator 69. Such exhaust brakes are well known and therefore it is not described in more detail. Other engines have divided exhaust systems and a plurality of exhaust restrictors are used for maximum braking effect. Also the exhaust restrictor may be upstream or downstream of a turbocharger.

Each exhaust valve is provided with a blocking device 22, described in more detail below, which can prevent closing of the exhaust valve. Each blocking device is electrically connected to an electronic control unit 56 by conductors 57.

The blocking devices 22 are hydraulically connected to engine oil pump 41 by oil lines 43. In this case the engine oil provided by the engine oil pump acts as hydraulic fluid for the blocking devices. Alternatively a separate hydraulic system or an electromagnetic system could be provided in other embodiments of the invention.

There is a solenoid valve 45 connected to the oil lines 43 between the pump and the blocking devices. The solenoid valve is operated by a switch in the cab of the vehicle and is opened to operate the blocking devices 22.

Figure 2:
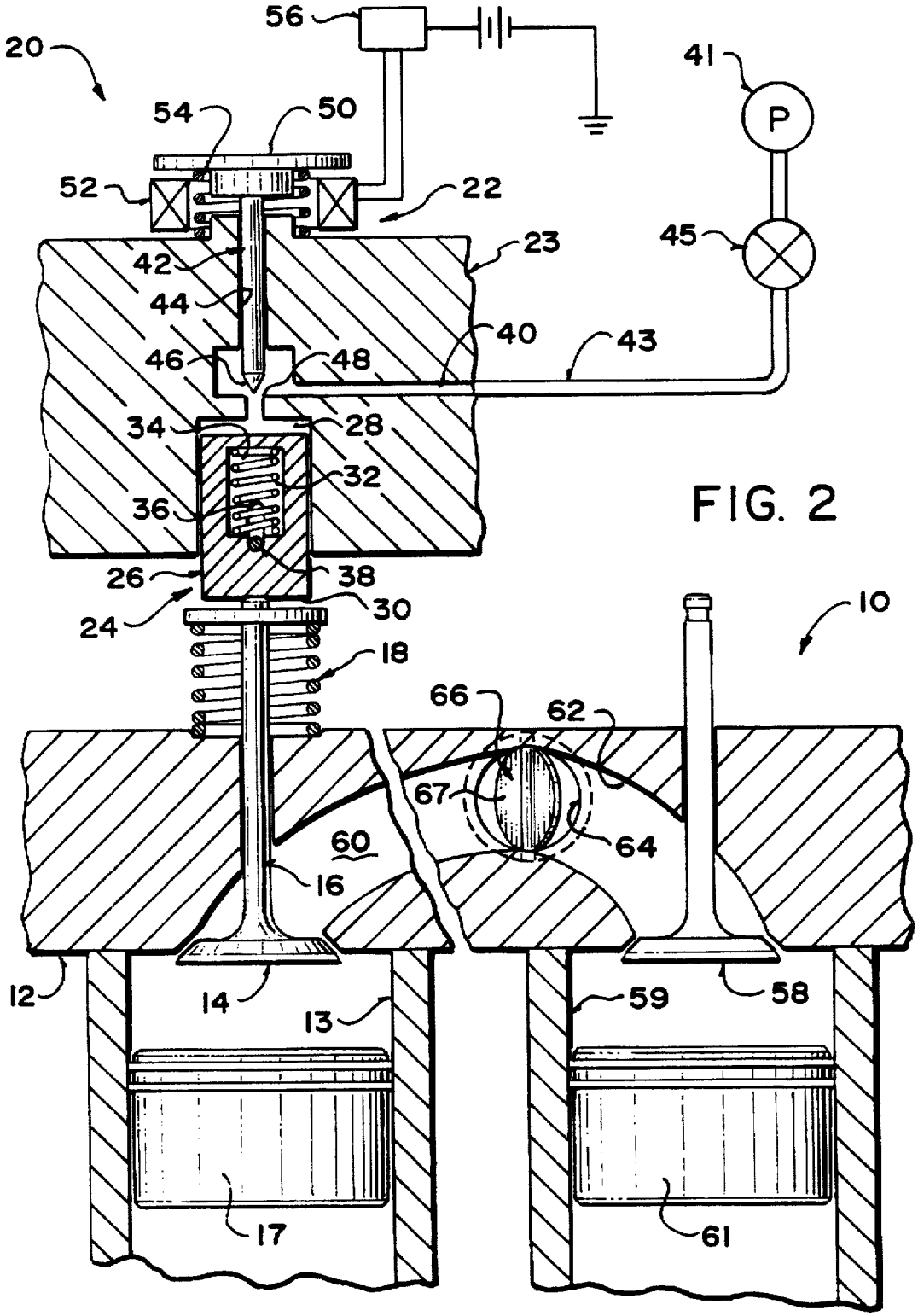
FIG. 2 is a fragmentary, partly diagrammatic sectional view of an embodiment thereof showing details of the exhaust valve and exhaust valve blocking device for one cylinder of the engine.

Referring to FIG. 2, this shows in fragment the diesel engine 10 including a portion of its cylinder head 12 and the exhaust valve 14 of cylinder 13. The exhaust valve is opened on a cyclic basis in the conventional manner by a camshaft which depresses valve stem 16 of the valve against the force of the valve spring 18. The camshaft acts on the valve through a conventional push tube and rocker arm arrangement.

The engine is fitted with an engine brake 20 including the valve blocking device 22 mentioned above. The engine brake is mounted in the cylinder head and includes an hydraulic actuator 24. Each cylinder of the engine is provided with a similar actuator. The actuator includes a piston 26 which is reciprocatingly positioned in hydraulic cylinder 28. The piston has a bottom end 30 which contacts the valve stem 16 of exhaust valve 14. For simplicity, the conventional valve opening mechanism is omitted in FIGS. 2, 3 and 4.

There is a return coil spring 32 located in a cylindrical hollow 34 within the piston 26. A vertically elongated slot 36 extends diametrically through the piston. A pin 38 extends through the slot and is fixedly secured to housing 23 of the engine brake. This pin serves to limit the travel of the piston toward the exhaust valve while the spring resiliently biases the piston away from the valve.

Conduit 40 extends through the housing to hydraulic cylinder 28 and is connected to the oil pump 41 by the oil lines 43 described above.

A needle valve 42 is slidably received in a bore 44 through the housing and has a pointed end 46 capable of sealingly engaging valve seat 48 between conduit 40 and cylinder 28 and therefore can serve as means for releasably shutting off a flow of fluid from the cylinder 28.

A disk 50, of steel or other magnetic material, is connected to the top of the needle valve. An electromagnetic actuator or solenoid 52 is located between the disk and the housing. A coil spring 54, located between the disk and the housing, biases the needle valve away from its seat 48 as shown.

Control unit 56 supplies electrical current to solenoid 52 when it is desired to keep valve 14 open outside its normal opening during the exhaust stroke.

FIG. 2 shows a second cylinder 59 of the engine provided with an exhaust valve 58 and a piston 61. Its exhaust port 62 is connected to the exhaust conduit 64 as is port 60 of valve 14. Exhaust brake 66 provided with butterfly 67 is fitted to the conduit 64. The exhaust brake is closed during operation of engine brake 20 and creates a back pressure of exhaust gases. This back pressure causes the exhaust valves, such as valve 14, to float a small amount off its seat, subsequent to the intake stroke and prior to, or near the beginning of, the compression stroke. In this example, however, the valve 14, together with the other exhaust valves, float approximately 0.005"–0.020" off their respective seats at the time indicated when the exhaust brake is operational. However this depends upon various factors including the particular engine involved, the clearance between the valves and the pistons and the number of exhaust valves per cylinder.

The purpose of each blocking device 22 is to maintain this cracking open of the exhaust valves, or a fraction thereof, after the float would normally stop. The timing is accomplished by the electronic control device 56 which is connected to the engine monitor in this embodiment.

Control unit 56 supplies current to solenoid 52 just prior to each compression stroke during brake operation. As stated above, the valve is slightly cracked open due to valve float induced by the exhaust brake 66 at that time. The solenoid attracts disk 50 downwards, from the point of view of FIG. 2, thus pressing the needle valve against its seat 48 and shutting off the flow of oil from cylinder 28 to conduit 40. The maximum downward movement of piston 26, which occurs when pin 38 contacts the top of the slot 36, is such that the valve 14 is kept cracked open a relatively small distance compared to its normal maximum opening. This may be all, or part of, the opening achieved by the float induced by the exhaust brake 66.

Current is supplied to the solenoid 52 throughout the compression stroke of the cylinder 13 in this example so piston 26 holds valve 14 open until the piston is near top dead center of the compression stroke. At this point, control unit 56 cuts off electrical current to solenoid 52. Spring 54 then acts to raise needle valve 42 off its seat 48 and thus allows oil to exit from cylinder 28 through conduit 40. This permits valve spring 18 to move piston 26 upwards, away from valve 14 and closes the valve. Alternatively the valve could be held open for only part of the compression stroke or after top dead center, but these alternatives are generally less advantageous.

As may be seen, engine brake 20 acts as a conventional weeper brake in that the exhaust valves are kept cracked open a small amount during the compression stroke. The braking effect is achieved as the gases are compressed and are forced to pass through the relatively small gap between the cracked open exhaust valves and their respective seats. However, the rebound force produced by the gases compressed within each cylinder is entirely or partly relieved by the time the piston reaches top dead center of the compression stroke by the escape of air past the cracked open exhaust valve. At that time however, unlike conventional weeper brakes, each exhaust valve is permitted to close so that the valve is not open during the subsequent intake stroke for four cycle engines (or power stroke for two stroke engines) which would otherwise reduce the charge of the cylinder prior to the subsequent compression stroke and accordingly reduce the braking, effect.

Figure 3:
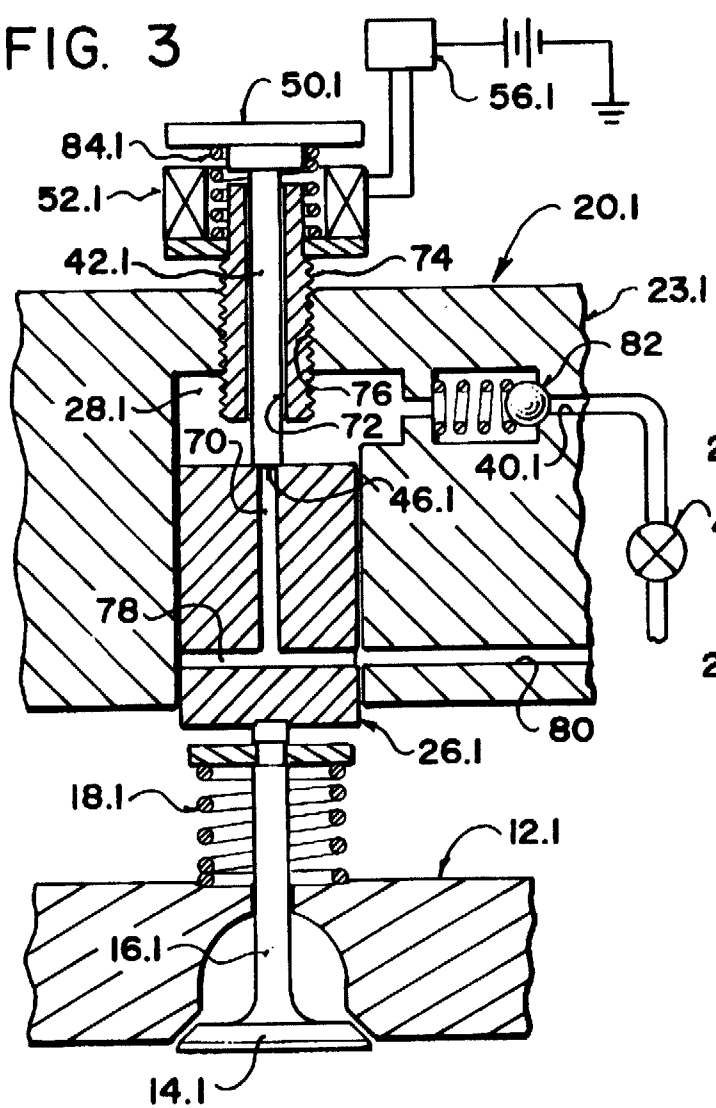
FIG. 3 is a view similar to FIG. 2 of a second embodiment of the invention.

FIG. 3 shows an alternative embodiment of the invention with provision for adjusting the amount the valve is cracked open. Corresponding parts are numbered the same as those in FIG. 2 but have the additional designation ".1". The structure and operation are similar except as described below.

In this example a valve member 42.1 replaces the needle valve of the previous embodiment. Its end 46.1 is blunt and is adapted to sealingly contact the top of piston 26.1 to block a flow of oil from conduit 70 which extends axially from the top of piston 26.1. Valve member 42.1 fits slidingly through central bore 72 of an adjustment screw 74 which threadingly engages a complementary threaded opening 76 in housing 23.1. Solenoid 52.1 is mounted on top of adjustment screw 74. Piston 26.1, in addition to axial conduit 70, also has diametrical conduit 78 communicating with conduit 70. In the illustrated position of the piston, conduit 78 is aligned with an oil drain 80 in the housing. Pressurized oil is supplied from the engine oil pump through conduit 40.1. Conduit 40.1 has a check valve 82 therein which blocks a flow of oil away from cylinder 28.1.

When solenoid valve 45.1 is opened, and control unit 56.1 supplies electrical current to solenoid 52.1 during the compression stroke, the distal end 46.1 of member 42.1 projects into cylinder 28.1 towards piston 26.1. The amount of this projection is adjustable by rotating screw 74. This adjustment can adjust the amount the exhaust valve is cracked open during the compression stroke to optimize brake performance for a particular engine.

During operation of the blocking device, the top of piston 26.1 contacts end 46.1 of member 42.1, preventing further upward movement of the piston by trapping oil in cylinder 28.1 between the top of piston 26.1 and check valve 82. The solenoid 52.1 is deactivated by control unit 56.1 near top dead center of the compression stroke. Spring 84.1 then moves member 42.1 away from the piston 26.1, allowing oil in cylinder 28.1 to flow out through bores 70 and 78 and drain 80. This allows piston 26.1 to move up and the valve 14.1 to close.

Figure 4:
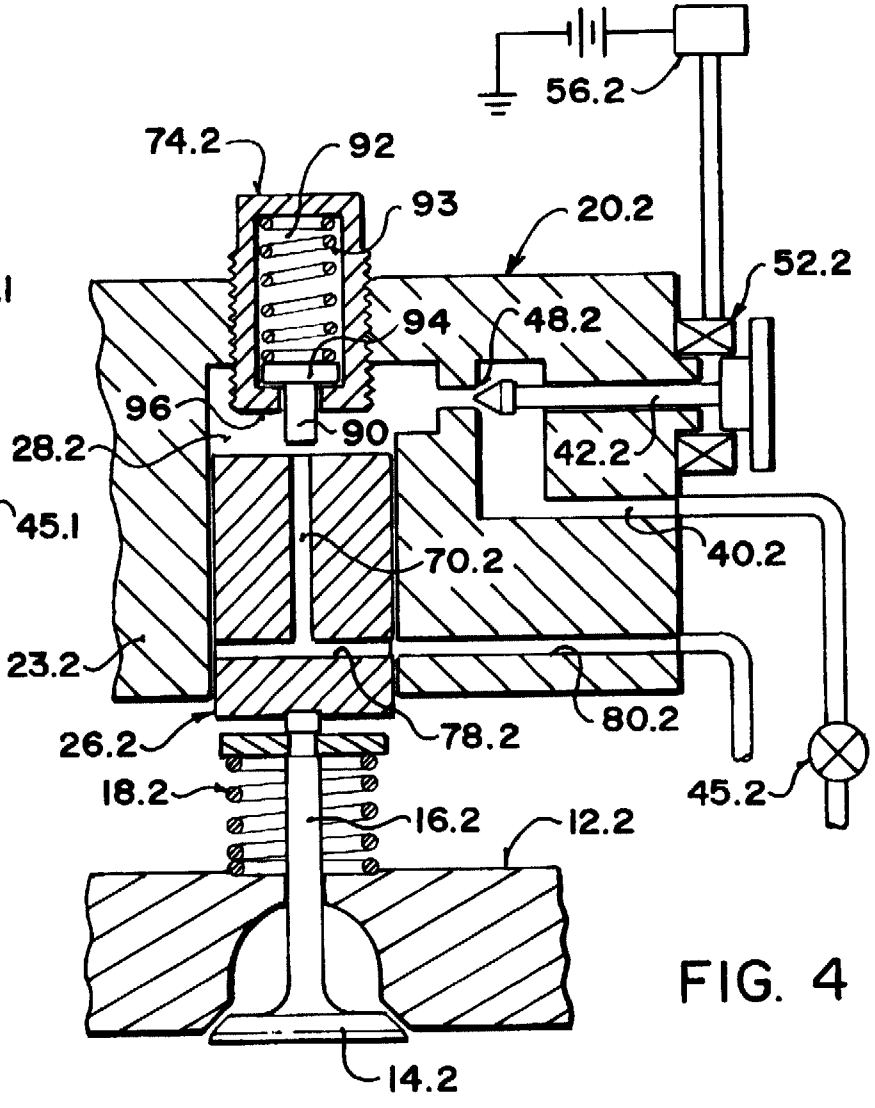
FIG. 4 is a view similar to FIG. 2 of a third embodiment of the invention.

FIG. 4 show another embodiment of the invention where like parts have like number to FIG. 1 or FIG. 2 with the additional designation ".2". This example functions generally similar to that of FIG. 3 except that the adjustment screw is separated from the solenoid 52.2. The solenoid is displaced to one side and retains a needle valve 42.2 with a seat 48.2 similar to FIG. 1.

Adjustment screw 74.2 has an interior hollow 92 with a coil spring 93 therein. A movable finger 90 projects from the interior of the screw and has an enlarged top 94 which is retained within the screw by annular flange 96 thereof. Spring 93 biases the finger downwardly. As with the embodiment of FIG. 3, the screw is adjusted so that the finger contacts the top of piston 26.2 until the piston has moved down a distance sufficient to keep the valve 14.2 cracked open the desired amount. It works similarly to the embodiment of FIG. 3 except that the oil is trapped in the cylinder 28.2 by the finger 90 contacting the top of conduit 70.2 and by needle valve 42.2 contacting its seat 48.2. When the piston of the relevant cylinder is near top dead center of the compression stroke, control unit 56.2 deactivates the solenoid so the pressurized oil moves the needle valve 42.2 off its seat. Valve spring 18.2 can then move the piston 26.2 upwardly, displacing oil into conduit 40.2 so the valve 14.2 can close.

Other types of actuators or blocking devices can be substituted for the particular examples described above. For example electromagnetic actuators can be used including those normally used for valve actuation for actuation on camshaftless engines. Another type would be that disclosed in U.S. Pat. No. 4,870,930 to Yagi.

Alternatively the apparatus may be operated as an improved exhaust brake which provides a braking or engine speed retarding effect for two different portions of each cylinder cycle. The effect occurs during both the exhaust strokes and the compression strokes. A normal exhaust brake, as discussed above, is effective only during exhaust strokes.

In some instances the actuators may open the exhaust valves at the beginning of the compression strokes without the need for valve float caused by high pressure in the exhaust conduits as described above. The exhaust brake may assist in providing enough back pressure to crack open the exhaust valves at the beginning of the compression strokes in conjunction with the actuators.

The use of an exhaust valve blocking device to catch each exhaust valve after they are opened by exhaust pressure, in embodiments employing this feature, prevents damage to the valves and their seats. This allows for higher pressures than in conventional engine brakes where valve bounce can cause such damage.

It will be understood by someone skilled in the art that many of the details provided above are by way of example only and are not intended to limited the scope of the invention which is to be interpreted with reference to the following claims.

What is claimed is:

1. An engine retarding apparatus for an engine with exhaust valves, comprising:

means for selectively raising exhaust pressure in the engine and causing each exhaust valve to float near the beginning of each compression stoke, said means including an exhaust restrictor; and means for blocking closing of said each exhaust valve until near the end of each compression stroke, said means for blocking including an exhaust valve blocking device.

2. An apparatus as claimed in claim 1, wherein the exhaust restrictor is an exhaust brake.

3. An apparatus as claimed in claim 1, wherein the blocking device includes an electromagnetic actuator.

4. An apparatus as claimed in claim 1, wherein the blocking device includes a solenoid actuated hydraulic valve.

5. An apparatus as claimed in claim 1, wherein the blocking device includes a hydraulic actuator.

6. An apparatus as claimed in claim 5, wherein the actuator operatively contacts said each exhaust valve to block closing of said each exhaust valve.

7. An apparatus as claimed in claim 6, wherein the blocking device has a hydraulic conduit and a hydraulic valve which selectively closes the conduit to hold the exhaust valve open.

8. An apparatus as claimed in claim 7, wherein the actuator has a piston operatively contacting the exhaust valve.

9. An apparatus as claimed in claim 8, wherein the piston has a hydraulic passageway therethrough, the hydraulic valve selectively blocking the passageway in the piston to hold the valve open.

10. An apparatus as claimed in claim 9, wherein the hydraulic valve has an electrical actuator.

11. An apparatus as claimed in claim 9, wherein the hydraulic valve has a valve member which contacts the hydraulic piston to block the passageway.

12. An apparatus as claimed in claim 11, wherein the hydraulic valve has an adjustment mechanism which adjusts the blocking of said each exhaust valve.

13. An apparatus as claimed in claim 12, wherein the adjustment mechanism has a threaded member connected to the valve member.

14. An apparatus as claimed in claim 11, wherein the valve member is resiliently biased towards the piston.

15. An engine brake for an engine with exhaust valves, comprising:

an exhaust restrictor capable of restricting exhaust flow from the engine sufficiently to float exhaust valves when normally closed; and an exhaust valve blocking device operatively connected to each said exhaust valve to keep said each exhaust valve cracked open during at least part of each compression stroke, the blocking device keeping said each exhaust valve open from near the beginning of each compression stroke until at least near the end of said each compression stroke.

16. An engine brake as claimed in claim 15, wherein the engine is a four cycle engine and the blocking device releases said each exhaust valve to permit said each exhaust valve to close prior to each intake stroke.

17. An engine brake as claimed in claim 16, wherein the blocking device releases said each exhaust valve near the end of each compression stroke.

18. A method of retarding an engine having cylinders and exhaust valves, the method comprising the steps of:

restricting exhaust gas flow from the engine sufficiently to cause float of the exhaust valves prior to each compression stroke; and holding open each said exhaust valve during said float and at least a portion of the compression stroke.

19. A method as claimed in claim 18, wherein said each exhaust valve is released and allowed to close prior to each intake stroke.

20. A method as claimed in claim 19, wherein said each exhaust valve is released near the end of each compression stroke.

21. An exhaust brake for an internal combustion engine with cylinders, exhaust valves, an exhaust conduit, exhaust strokes and compression strokes, the brake comprising:

an exhaust restrictor along the exhaust conduit, the exhaust restrictor being selectively operable to retard engine speed by restricting outflow of exhaust gases from the engine; and means for selectively holding open each exhaust valve of each said cylinder for a time beginning after each said exhaust valve is exhaust stroke of said each cylinder, near bottom dead center of each compression stroke of said each cylinder, whereby the exhaust restrictor causes retarding of engine speed from said each compression stroke.

22. A brake as claimed in claim 21, wherein said each exhaust valve is held open until near top dead center of said each compression stroke.

23. A brake as claimed in claim 21, wherein the means for holding open includes an actuator.

24. A brake as claimed in claim 23, wherein the actuator is an electromagnetic actuator.

25. A brake as claimed in claim 24, wherein the actuator is an hydraulic actuator.

26. A brake as claimed in claim 21 wherein the actuator opens said each exhaust valve near bottom dead center of each compression stroke.

27. A brake as claimed in claim 21, wherein the exhaust restrictor restricts the exhaust gases sufficiently to float each said exhaust valve near bottom dead center of each said compression stroke, said means holding open said each exhaust valve after said each valve is floating.

28. A method of retarding an engine having cylinders, each said cylinder having an exhaust valve and an exhaust restrictor, the method comprising the steps of:

holding cracked open the exhaust valve of said each cylinder after each said exhaust valve is closed after each exhaust stroke of said each cylinder, for at least a portion of compression strokes beginning near bottom dead center thereof; and operating the exhaust restrictor while the exhaust valve is so cracked open during said portion of the compression strokes.

* * * * *